US009028588B2

(12) United States Patent
Hess

(10) Patent No.: US 9,028,588 B2
(45) Date of Patent: May 12, 2015

(54) PARTICLE GUIDE COLLECTOR SYSTEM AND ASSOCIATED METHOD

(76) Inventor: Donald H. Hess, Dunedin, FL (US)

( * ) Notice: Subject to any disclaimer, the term of this patent is extended or adjusted under 35 U.S.C. 154(b) by 729 days.

(21) Appl. No.: 13/233,731

(22) Filed: Sep. 15, 2011

(65) Prior Publication Data

US 2012/0085234 A1 Apr. 12, 2012

Related U.S. Application Data

(60) Provisional application No. 61/383,118, filed on Sep. 15, 2010.

(51) Int. Cl.

| | |
|---|---|
| ***B03C 3/155*** | (2006.01) |
| ***B03C 3/38*** | (2006.01) |
| ***B03C 3/09*** | (2006.01) |

(52) U.S. Cl.

CPC . *B03C 3/09* (2013.01); *B03C 3/155* (2013.01); *B03C 3/383* (2013.01); *B03C 2201/04* (2013.01); *B03C 2201/10* (2013.01)

(58) Field of Classification Search

CPC ..... B03C 3/00; B03C 3/34; B03C 3/36; B03C 3/38; B03C 3/40; B03C 3/41; B03C 3/45; B03C 3/66; B03C 3/82; B03C 3/86; B03C 9/00; B03C 11/00; B03C 2201/10; B03C 2201/14; B03C 3/09; B03C 3/155; B03C 3/383; B03C 2201/04

USPC ..... 95/63; 96/54, 55, 77

See application file for complete search history.

(56) References Cited

U.S. PATENT DOCUMENTS

| | | | |
|---|---|---|---|
| 1,357,466 | A | 11/1920 | Moller |
| 2,906,369 | A | 9/1959 | Lagarias |
| 3,984,215 | A | 10/1976 | Zucker |
| 3,985,524 | A | 10/1976 | Masuda |
| 4,056,372 | A | 11/1977 | Hayashi |
| 4,094,653 | A | 6/1978 | Masuda |
| 4,170,447 | A | 10/1979 | Goldstein et al. |
| 4,209,306 | A | 6/1980 | Feldman et al. |
| 4,265,641 | A | 5/1981 | Natarajan |
| 4,357,150 | A | 11/1982 | Masuda et al. |
| 4,496,375 | A | 1/1985 | Le Vantine |
| 4,690,694 | A | 9/1987 | Alig et al. |
| 4,734,105 | A | 3/1988 | Eliasson et al. |
| 4,781,736 | A | 11/1988 | Cheney et al. |
| 4,822,381 | A | 4/1989 | Mosley et al. |
| 4,979,364 | A | 12/1990 | Fleck |
| 5,061,296 | A | 10/1991 | Sengpiel et al. |
| 5,199,257 | A | 4/1993 | Colletta et al. |
| 5,255,178 | A | 10/1993 | Liberati |
| 5,282,891 | A | 2/1994 | Durham |
| 5,401,299 | A | 3/1995 | Kroeger et al. |

(Continued)

FOREIGN PATENT DOCUMENTS

| | | | |
|---|---|---|---|
| EP | 0646416 | A | 4/1995 |
| JP | S5233173 | A | 3/1977 |

(Continued)

*Primary Examiner* — Duane Smith
*Assistant Examiner* — Sonji Turner
(74) *Attorney, Agent, or Firm* — GrayRobinson, P.A.; Michael J. Colitz, III

(57) ABSTRACT

Disclosed is a filtration system and method that uses a corona discharge grid and a series of electrostatic grids to filter ambient particles. The filtration system eliminates, or greatly reduces, the pressure drop across the associated filter media.

8 Claims, 10 Drawing Sheets

(56) References Cited

U.S. PATENT DOCUMENTS

| | | | | |
|---|---|---|---|---|
| 5,403,383 | A | 4/1995 | Jaisinghani | |
| 5,542,964 | A | 8/1996 | Kroeger et al. | |
| 5,547,493 | A | 8/1996 | Krigmont | |
| 5,547,496 | A | 8/1996 | Hara | |
| 5,549,735 | A * | 8/1996 | Coppom | 96/63 |
| 5,593,476 | A * | 1/1997 | Coppom | 95/78 |
| 5,645,627 | A * | 7/1997 | Lifshutz et al. | 96/15 |
| 5,647,890 | A | 7/1997 | Yamamoto | |
| 5,695,549 | A | 12/1997 | Feldman et al. | |
| 5,707,422 | A | 1/1998 | Jacobsson et al. | |
| 5,707,428 | A | 1/1998 | Feldman et al. | |
| 5,711,788 | A | 1/1998 | Kim et al. | |
| 5,733,360 | A | 3/1998 | Feldman et al. | |
| 5,787,704 | A * | 8/1998 | Cravero | 60/274 |
| 6,004,376 | A | 12/1999 | Frank | |
| 6,162,285 | A | 12/2000 | Fong et al. | |
| 6,245,132 | B1 * | 6/2001 | Feldman et al. | 96/28 |
| 6,245,299 | B1 | 6/2001 | Shiloh et al. | |
| 6,251,171 | B1 * | 6/2001 | Marra et al. | 96/69 |
| 6,375,714 | B1 | 4/2002 | Rump et al. | |
| 6,491,743 | B1 * | 12/2002 | Joannou et al. | 96/67 |
| 6,611,440 | B1 | 8/2003 | Johnston et al. | |
| 6,635,106 | B2 * | 10/2003 | Katou et al. | 96/67 |
| 6,713,026 | B2 | 3/2004 | Taylor et al. | |
| 6,773,489 | B2 | 8/2004 | Dunn | |
| 6,790,259 | B2 | 9/2004 | Rittri et al. | |
| 6,872,238 | B1 | 3/2005 | Truce | |
| 6,878,192 | B2 | 4/2005 | Pasic | |
| 6,989,049 | B2 | 1/2006 | Belson et al. | |
| 7,156,898 | B2 * | 1/2007 | Jaisinghani | 95/63 |
| 7,160,363 | B2 * | 1/2007 | Kulmala et al. | 96/67 |
| 7,175,695 | B1 | 2/2007 | Hess | |
| 7,261,765 | B2 | 8/2007 | Katayama | |
| 7,404,847 | B2 | 7/2008 | Hess | |
| 7,513,933 | B2 * | 4/2009 | Coppom et al. | 95/70 |
| 7,803,213 | B2 | 9/2010 | Hess | |
| 2001/0025570 | A1 | 10/2001 | Fukushima | |
| 2004/0159232 | A1 | 8/2004 | Mohamed | |
| 2006/0150816 | A1 * | 7/2006 | Jaisinghani | 96/67 |
| 2007/0022876 | A1 | 2/2007 | Hess | |
| 2007/0137479 | A1 | 6/2007 | Hess | |
| 2008/0295693 | A1 * | 12/2008 | Hess | 96/54 |

FOREIGN PATENT DOCUMENTS

| | | | |
|---|---|---|---|
| JP | S5245781 | A | 4/1977 |
| JP | H07246347 | A | 9/1995 |
| JP | H11156237 | A | 6/1999 |
| JP | 2001334172 | A | 12/2001 |
| JP | 2003103196 | A | 4/2003 |

* cited by examiner $$\Delta P = P_1 - P_2$$

PARTICLE GUIDE COLLECTOR SYSTEM AND ASSOCIATED METHOD

CROSS-REFERENCE TO RELATED APPLICATIONS

This application claims priority to Provisional Application Ser. No. 61/383,118 filed on Sep. 15, 2010 and entitled "No (Very Low) Pressure Drop Filtration System (NPDFS)." The contents of this application are fully incorporated herein for all purposes.

FIELD OF THE INVENTION

This invention relates to a filtration system for airborne particles. More particularly, the present invention relates to a no pressure drop filtration apparatus, which eliminates the pressure drop across the filter media while still providing satisfactory filter efficiency.

BACKGROUND AND INTRODUCTION OF INVENTION

Particle trajectory in a room environment is controlled dominantly by two forces, airflow, and electromagnetic fields. These two forces are the dominant transport mechanism for particles. Two equations dictate particle behavior. Force equals the change in momentum of the particle (F=ma), due to airflow. The airflow must overcome the charge times the electric field E (F=qE) due to electric forces in the room environment.

Note 1: F is the force, m is the mass, a is acceleration, and E is the electric field. Note 2: "E", "F", and "a" are vectors. This means the quantity has both magnitude and a direction. For example, E has both magnitude and direction.

The first equation (F=ma) describes how airflow controls particle trajectory and the second equation (F=qE) describes how the electric field controls particle trajectory.

When a media filter is placed in an airstream it has a pressure drop across it because it is placed perpendicular to the airflow. Air must pass through the media material. Pressure drop is the force required per unit of surface area that a fan must overcome to allow the proper airflow to pass through the filter material. The more efficient the filter, the more dense the material in the filter, and as a result the higher the pressure drop to allow the proper airflow through the filter. As an example, a HEPA filter can have over an inch and a half of static pressure drop across it.

Pressure drop is directly related to higher energy usage. The fan in an HVAC System must work harder to force air through the filter (FIG. 1). FIG. 1 illustrates that in order to maintain proper airflow across a high efficiency filter the fan in an HVAC air system must run at a higher rate which required more energy usage. Some Fans cannot operate under these high pressure drop conditions. The pressure drop across the system is $\Delta P=P_1-P_2$. This means more energy usage which equates to more costs.

Some HVAC fans do not have the capability to operate under high pressure drop conditions. Furthermore, a fan that has the capability to create the acceptable pressure drop across a high efficiency filter must use more energy, in the form of kilowatt hours, and create more noise (unacceptable in certain environments, including hospital care facilities). These are the reasons it has been difficult to incorporate sufficient air purification in some of these HVAC systems. In any air handling system the struggle has always been to incorporate efficient filters and still maintain acceptable air flow rates through these systems. The result has been high energy costs to run the HVAC fan in the air conditioning system to provide the pressure drop needed to maintain acceptable airflow. Another example of a system that cannot withstand any pressure drop through it is the Chilled Beam Induction System, which is described in more detail below.

Therefore, in this disclosure a filtration system was developed with no, or very low, pressure drop across it. This system has acceptable filter efficiency without the associated pressure drop.

Aerosols are composed of either solid or liquid particles, whereas gases are molecules that are neither liquid nor solid and expand indefinitely to fill the surrounding space. Both types of contaminates exist at the micron and sub-micron level. Most dust particles, for example, are between 5-10 microns in size (a micron is approximately 1/25,400th of an inch). Other airborne contaminates can be much smaller. Bacteria and viruses are an example of airborne contaminates. Bacteria commonly range anywhere between 0.3 to 2 microns in size. Viruses can be as small as 0.02 microns in size. The importance of removing these contaminates varies based upon the application. Semiconductor clean rooms and hospital operating rooms are two examples of spaces where the ability to remove contaminates is critical. One factor complicating the removal of contaminates is that particle number density increases with smaller particle size. For example, in the typical cubic foot of outside air there are approximately 1000 10-30 micron sized particles. The same volume of air, however, contains well over one million 0.5 to 1.0 micron particles. Ultimately, over 98% of all airborne particles are less than a micron in size. The prevalence of small particles is problematic from an air quality standpoint because small particles are hard to control and capture. Transport Mechanisms are what causes particles in the air to move from point A to point B. In every building environment there are forces present that determine these transport mechanisms and control particle movement. The major types of forces on particles in a building environment are caused by airflow and/or electromagnetic fields (or forces). When a particle approaches a strong electrostatic field, say a negative 15 kV field, a dipole is formed. Some of the positive charges in the particle will move toward the strong field (front of the particle) and some of the negative charges will move towards the opposite end (rear) of the particle, away from the static field. Once this occurs the particle passes through the electrostatic field. If a second static field, of the same potential is downstream from the first static field the particle propels toward it. Attached to the second static field is a media material, made up of dielectric material (such as fiberglass) the particle propels into the media material and gets trapped. Thus the particle gets filtered, note FIG. 2. FIG. 2 illustrates that when a particle approaches the −10 kV electrostatic field it forms a dipole (A,B). If a second −10 kV electrostatic field is placed downstream from the first field the particle propels towards it (opposite charges attract) (C). If a dielectric media material is placed in the Second field it picks up the charge of the electric field and acts as a trap to the particle (D).

Electronic Charging of a Particle −A corona field is an ion field that is created by a very thin wire or a thin metal blade with a serrated edge. If a negative high voltage is applied to the wire or metal edge, electrons are created in the air surrounding the wire or blade. When a particle passes through this created electron field the particle acquires some of the electrons and becomes a negative ion. FIG. 3 illustrates this point. FIG. 3 illustrates that when a particle approaches the −15 kV electrostatic ion field it forms a negative ion out of the particle. If a second −15 kV electrostatic field is placed downstream from the first field the particle is deflected from it (like charges repel). If a +15 kV field is placed as above the negative ion is propelled toward it. As can be seen, when a particle passes through the negative ion field (electrons) it becomes negatively charged.

If a "V" shaped grid is placed in the path of the particle, and has the same voltage applied to it as the corona grid the particle will be repelled by it (like charges repel each other). If a positive set of grids are placed to the side of the first set of grids, as shown in FIG. 3, the particle will be propelled towards the positive grid (unlike charges attract each other).

SUMMARY OF THE INVENTION

It is therefore an object of this invention to create a filtration system that eliminates, or greatly reduces, the pressure drop across the filter media.

It is another object of this invention to create a filtration system wherein electromagnetic fields are the dominate transport mechanism.

Still another object of this invention is to use electromagnetic fields to control particle trajectories.

Still another objective is to control small particles by forming dipoles and projecting them into a media without agglomerating these particles.

Still another objective is to use only electromagnetic fields to control particles and not airflow.

It is therefore one of the objectives of this invention to provide a Particle Guide Collector System (PGCS) wherein a series of metal grids were either thin serrated edges or thin wires are utilized to create negative ions out of entering ambient particles, and then to allow these particles to be guided by metal grids appropriately charged to make electromagnetic fields the dominate transport mechanism thus creating a PGCS.

These and other objectives are carried out using a complex grid system and a static field of −15 kV and +15 kV are utilized. When particles pass through the corona field, set up by the serrated edged thin blades, the particles take on a negative charge. The "V" shaped grids are also −15 kV, as can be seen. However, they are not a set of thin serrated blades or thin wires. They do not create a corona field. They are a wire mesh grid system that sets up a plane of charge. They are placed in the path of the negative ions to deflect them towards the sidewalls of the system. A set of positively charged grids (made the same way as the negative charged grid, are placed on a dielectric filter material that is positioned on the sidewalls of the NPDFS and in parallel to the airflow thus creating no pressure drop across the airflow stream. The field in the positive grid attracts the deflected ions toward the filter media (it has the opposite charge of +15 kV applied to it). The dielectric media filter pad is placed behind each of the two +15 kV grids shown in FIG. 6. Since it is a dielectric material the media material becomes charged by the positive grid and the oppositely charged particles are propelled into the media material and get trapped. The grids are placed so that airflow will not be reduced when passing going to the filtration section (FIG. 3). A no pressure drop filtration system has been created.

Another iteration of the NPDFS is a series of two grid systems with a static field of −15 kV each. When particles pass through the first static field, set up by a grid (not a corona blade or wire), the particles became dipolar (with the positive end of the particle in front and the negative end in the back of the particle). The second grid is placed close enough to the first grid for the dipolar particle to propel toward it. However, the grid is placed outside the airstream (FIG. 4). FIG. 4 illustrates that when a particle approaches the −15 kV field it forms a dipole (A,B). If a second −15 kV field is placed downstream from the first field, close to it and out of the path of airflow, the particle propels toward it (C,D). If a dielectric material is placed in the second field it "catches" the propelled particle and acts as a trap. It is therefore one of the objectives of this invention to provide a filtration system with zero pressure drop. A dielectric media is placed behind this second grid. The media material becomes charged and the polarized particles are propelled into the media material and get trapped. A very low pressure drop filtration system has been created.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 5(*b*) is a diagram of an output grill showing supply and return.

Similar reference characters refer to similar parts throughout the several views of the drawings.

DETAILED DESCRIPTION OF THE DRAWINGS

The present invention relates to a method and apparatus that uses a corona discharge grid and a series of electrostatic grids to create a no pressure drop filtration system. The various components of the present invention, and the manner in which they interrelate, are described in greater detail hereinafter.

Figure 9A:
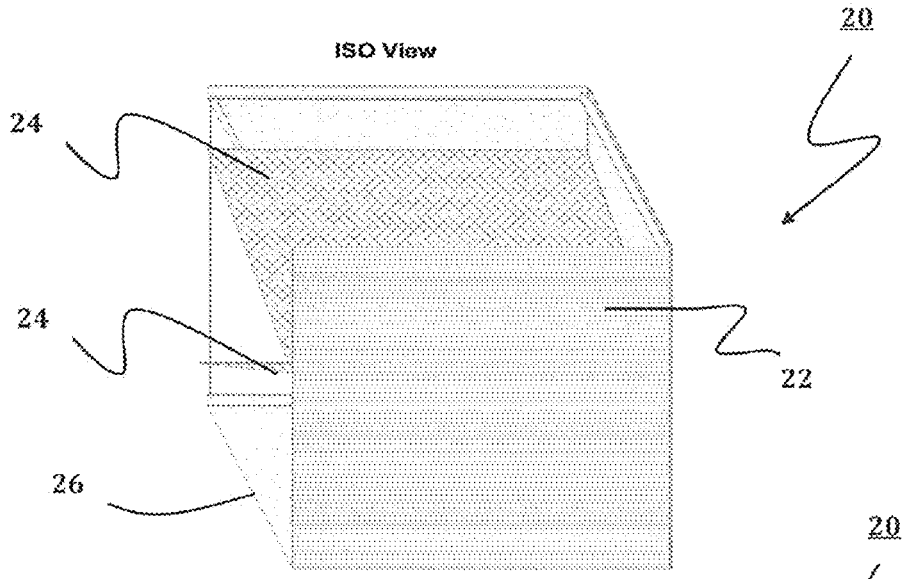
FIG. 9(*a-b*) are an iteration of the PGCS.
Figure 9B:
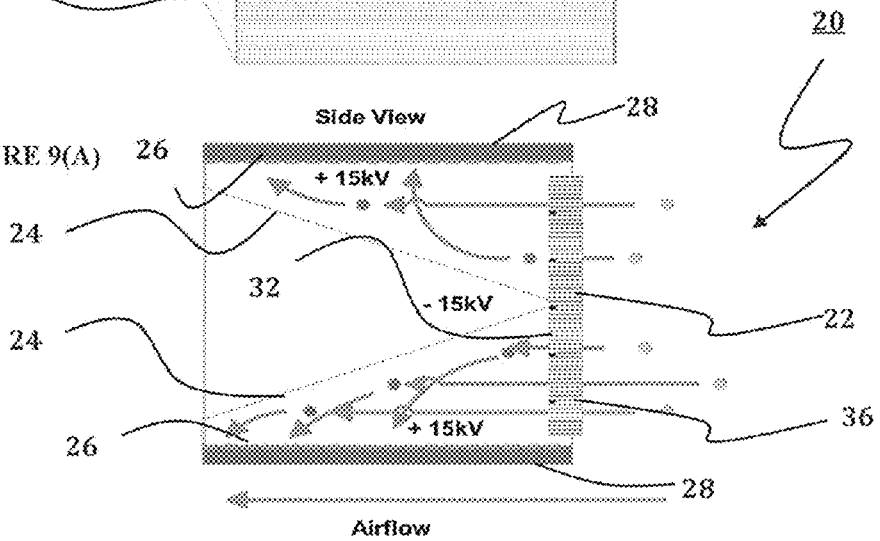
Figure 10:
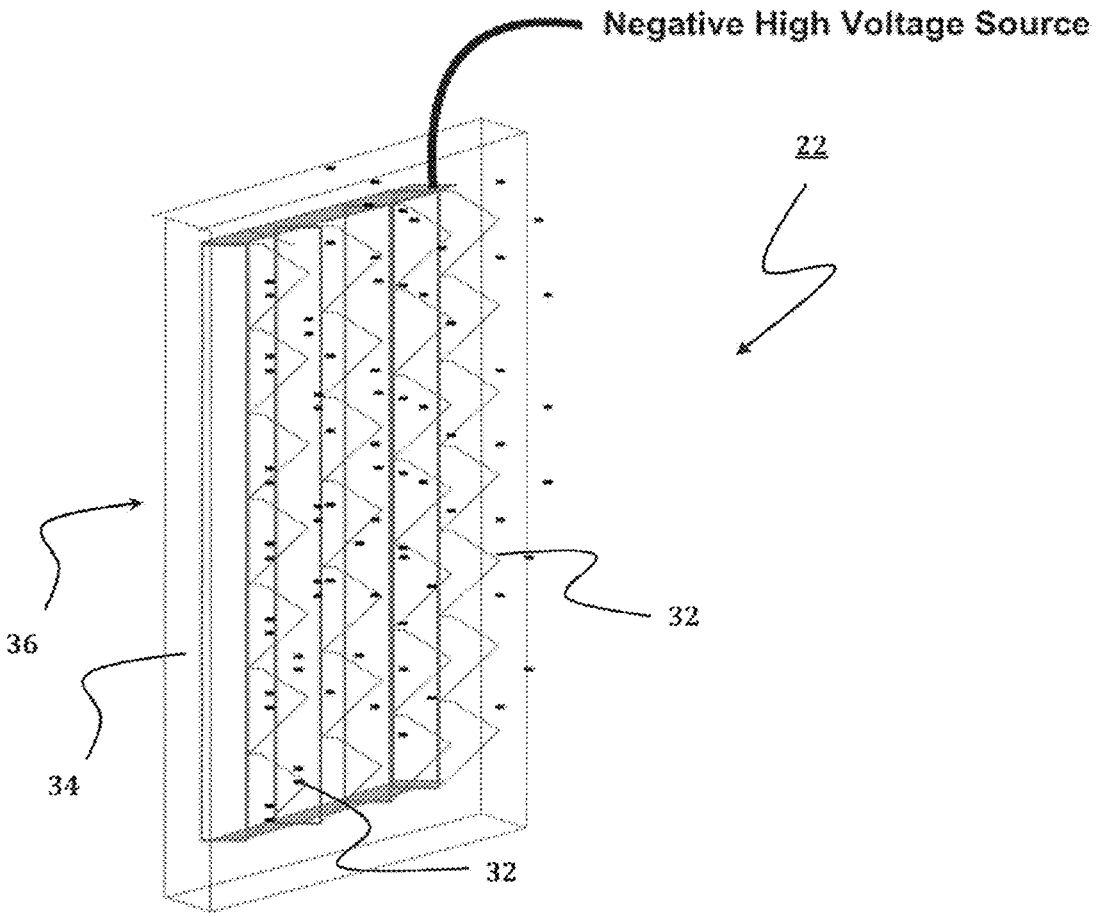
FIG. 10 is a corona discharge apparatus.
Figure 11:
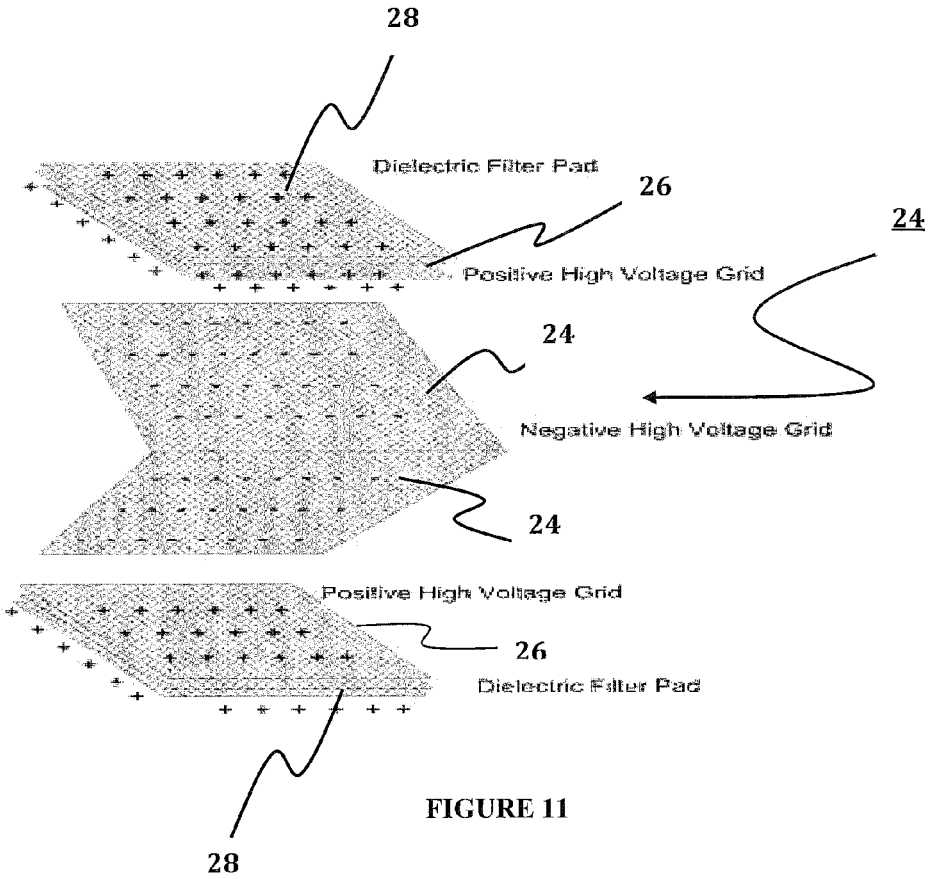
FIG. 11 is a grid setup to produce negative and positive charge planes.

In the preferred system is depicted in FIGS. 9-11. The system 20 employs a corona discharge apparatus 22, a negative "V" bank 24, and a positive set of grids 26 that are placed on a dielectric media material 28.

In the preferred embodiment, the corona discharge apparatus 22 creates an electron field along a serrated edge 32 by way of a power source (note FIG. 10). Apparatus is preferably orientated at a 90 degree angle to the flow of ambient air. A first set of grids are then placed in the path of particles in the shape of the "V" bank 24. The V-bank includes an apex and a base. The apex is preferably adjacent to the corona discharge apparatus 22. A second set of grids 26 are placed on two dielectric filter pads 28 respectively (note FIG. 11).

The operation of the corona discharge apparatus 22 and each of the grids (24, 26) are described in greater detail hereinafter in conjunction with FIGS. 9-11. In the preferred embodiment the corona discharge apparatus 22 is formed of a series of serrated blades 32. Blades 32 are placed in a housing 34 and are parallel to each other. When current is applied to the thin serrated blades 32 an electron cloud forms in the ambient space around each blade 32. In operation, air from the inlet 36 of the corona discharge apparatus is delivered between adjacent conductors and past the serrated surfaces of the blades 32. The field generated by the corona discharge apparatus serves to ionize otherwise neutral particles within the ambient air. Because the corona apparatus uses a negative voltage applied to it, negative charged particles are generated and transported away from the corona discharge apparatus 32 (FIG. 10). In the alternative, the particles can be polorized as opposed to ionized.

The negative and positive charged (24, 26) grids are next described in conjunction with FIG. 9. The "V" bank 24 is negatively charged with the same voltage as the corona discharge apparatus 22. When negative current is applied to the "V" grid 24 a negative "plane or wall" is created. When the negatively charged particles are near the negative plane they are repelled toward the second set of grids 26. This second set of grids 26 are positively charged via a power source and thus set up a positive "plane or wall". The second set of grids 26 are each located in front of a dielectric media material 28 that attracts the negative particles into the material thus acting as a filter. In the preferred embodiment grids 26 take the form of upper and lower grids that are positioned above and below the V-grid 24. Grids 26 are also preferably at a 90 degree angle to the corona discharge apparatus 22. As such, ambient particles are guided first through corona discharge apparatus 22 and then guided at a 90 degree angle into the filer media 28. This results in no, or very low, pressure drop across the filter media.

Although the present invention is not limited to any particular voltage, up to 100 kV is acceptable for the corona discharge apparatus 22 and the negative and positive grids (24, 26). The only limitation is the amount of ozone acceptable created by the corona discharge apparatus and current arcing is unacceptable.

There are other embodiments of the present invention. For example, a positive corona discharge apparatus 22 can be employed. The second and third grids (24, 26) need only use opposite fields (grid set 24 will be positive and grid set 26 would be negative).

The steps associated with the present method are detailed below. First, the corona discharge grid conditions ambient particles by giving them a negative charge. Second, these charged particles then delivered to subsequent grids. Third, one set of grids repels the particles and another set attracts the particles. It is understood, that the second set of grids are placed on a dielectric media material that acts as the collection filter. The first set of grids are shaped in a "V" and have a negative charge applied to them. This negative charge plane repels the negatively charged particles toward a second set of grids. The second set of grids are positively charged. The second set of grids are placed on a dielectric media material that takes on the same charge as the grid. The positive grid attracts the negatively charged particles and they are propelled into the dielectric media material, thus filtering the particles.

Another preferred iteration can be used in a Chilled Beam System. A Chilled Beam does not have the capability to operate if a media filter is employed because of the pressure drop conditions created. If any pressure loss is experienced in a Chilled Beam the system is compromised. This is the reason no Chilled Beam System has incorporated air purification. The system of the present invention creates a no pressure drop collector system.

Figure 1:
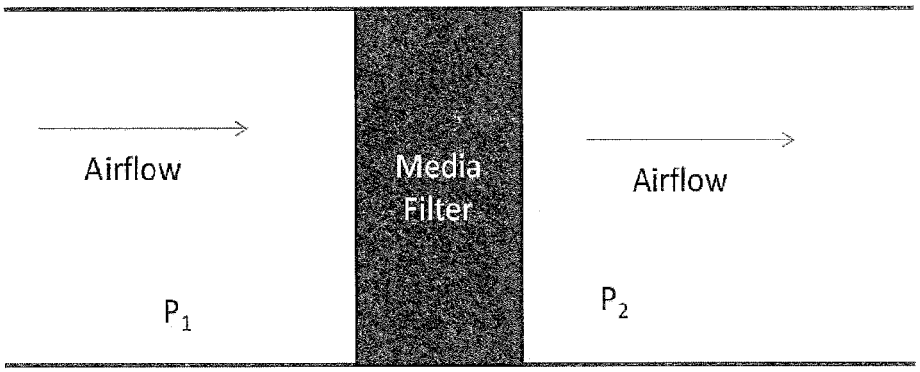
FIG. 1 is a diagram of airflow across a high efficiency filter.
Figure 2:
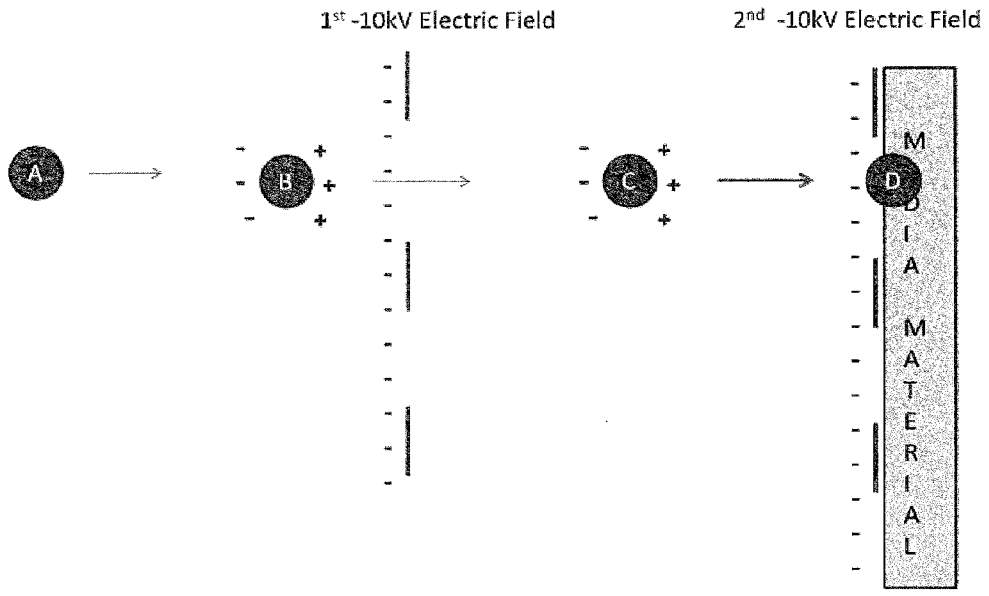
FIG. 2 is a diagram of a particle approaching a −10 kV field.
Figure 3:
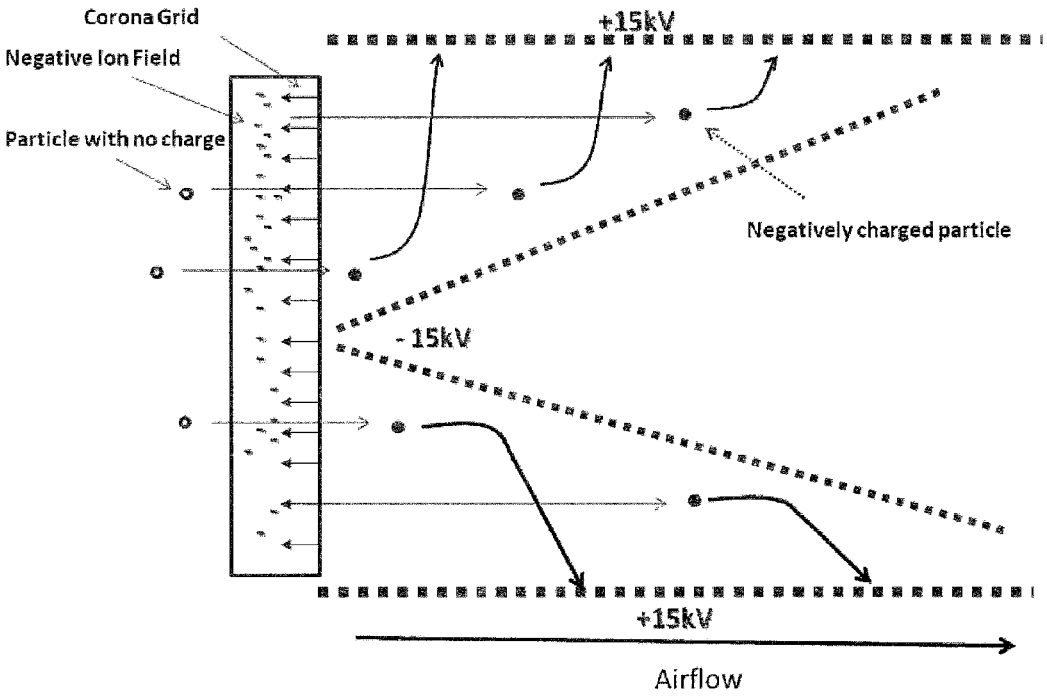
FIG. 3 is a diagram of a particle approaching a −15 kV electrostatic field.
Figure 4:
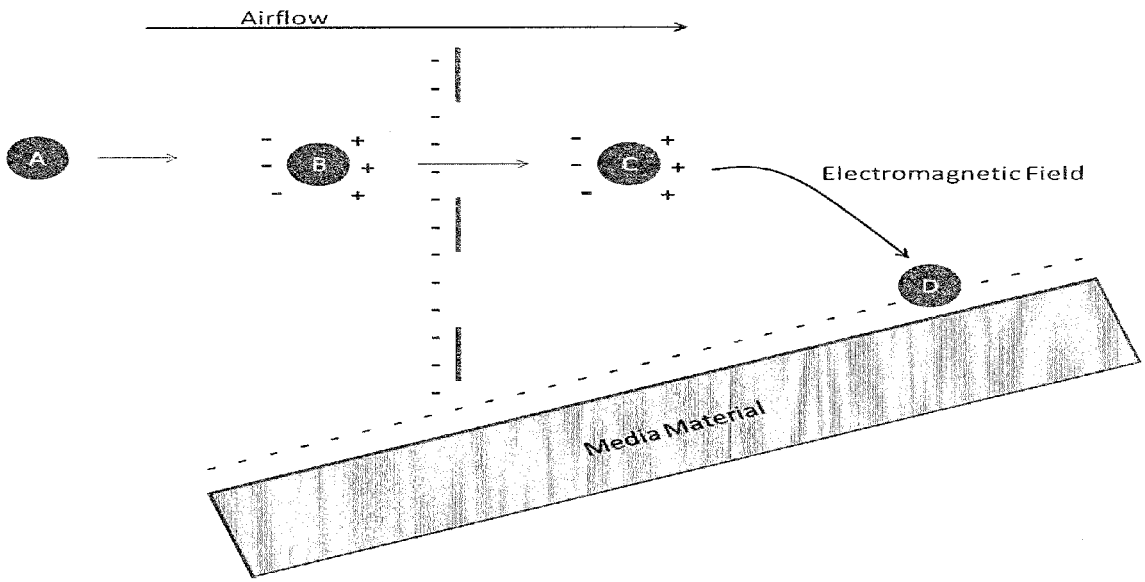
FIG. 4 is a diagram of a particle approaching a −15 kV field.
Figure 5A:
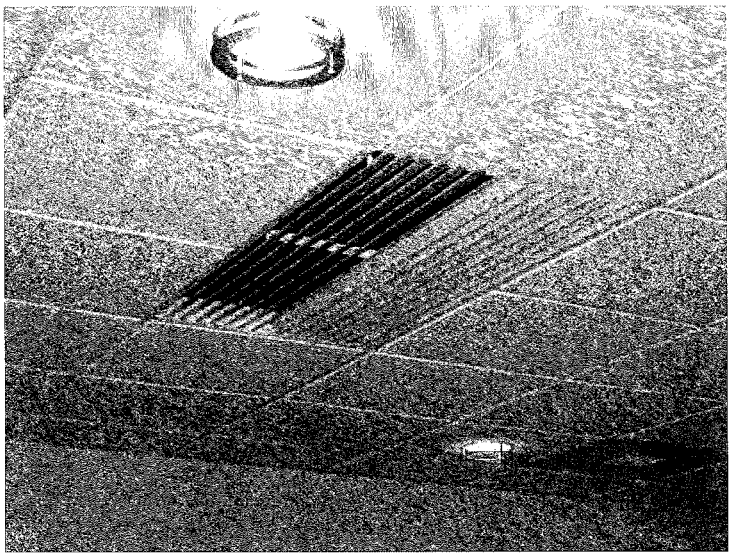
FIG. 5(*a*) is a diagram of a chilled beam.
Figure 5B:
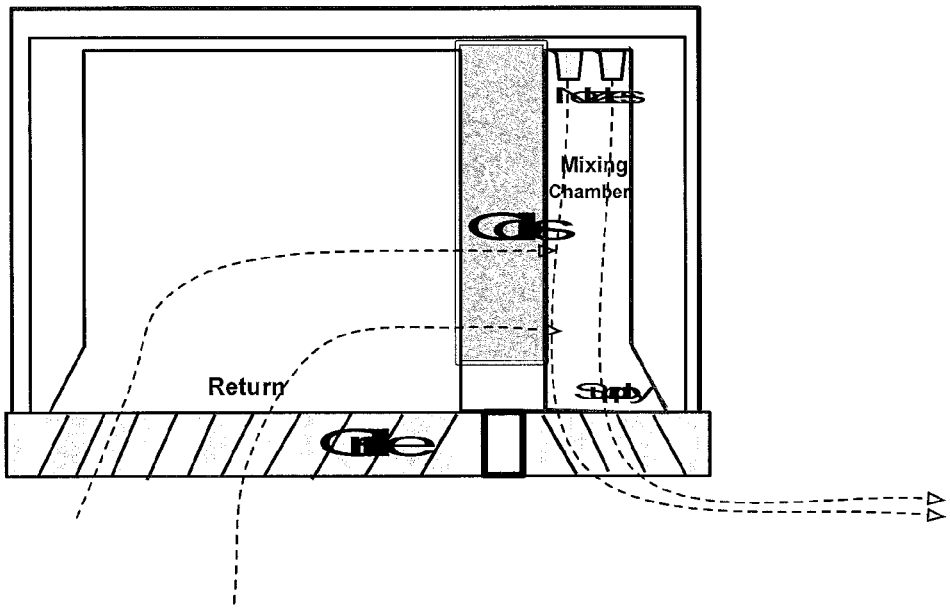

To summarize, a Chilled Beam takes primary air from a dedicated outside air unit (Air Handling System) and distributes the air through a bank of specially designed nozzles. It then discharges the air at a high velocity into a mixing chamber inside the Chilled Beam (FIG. 5*a*). This creates a differential pressure, which enables a draw of room air across the internal coil. The primary air and the induced air are mixed and discharged through a grille. This creates a Coanda effect in the air distribution at the ceiling of the room environment. This air circulates throughout the room and is gently drawn back up through the return section of the Chilled Beam grille (FIG. 5*b*).

Figure 6:
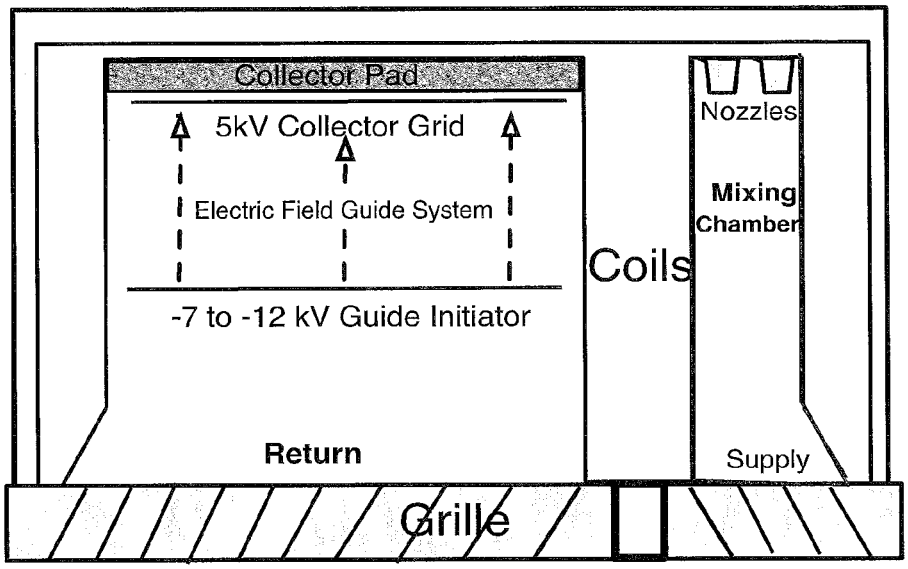
FIG. 6 is a particle guide system placed in a chilled beam.

A PGCS is placed in the return section of the Chilled Beam (FIG. 6) and is made up of a grid system composed of a Particle Guide Initiator employing a pulsed electric field of −15 to −25 kV/inch and a Collector System which includes a pulsed electric field grid of +5 kV/inch and a collector pad. When particles pass through the field set up by the Initiator the particles take on a negative charge. The grid sets up a plane field of charge. A positive charged grid is positioned on a specially designed dielectric collector, not obstructing the air path. This creates no pressure drop across the airflow stream. The field through the collector attracts the guided particles toward the collector (it has the opposite charge applied to it than the Initiator). Since the collector itself is made of a special dielectric material the media material becomes charged by the positive grid and the oppositely charged particles are propelled into the media material and get trapped. Inelastic collisions occur creating ionic bonds between the particle and the collector material (the particle becomes attached to the collector). In this way a no pressure drop collector system has been created.

Figure 7:
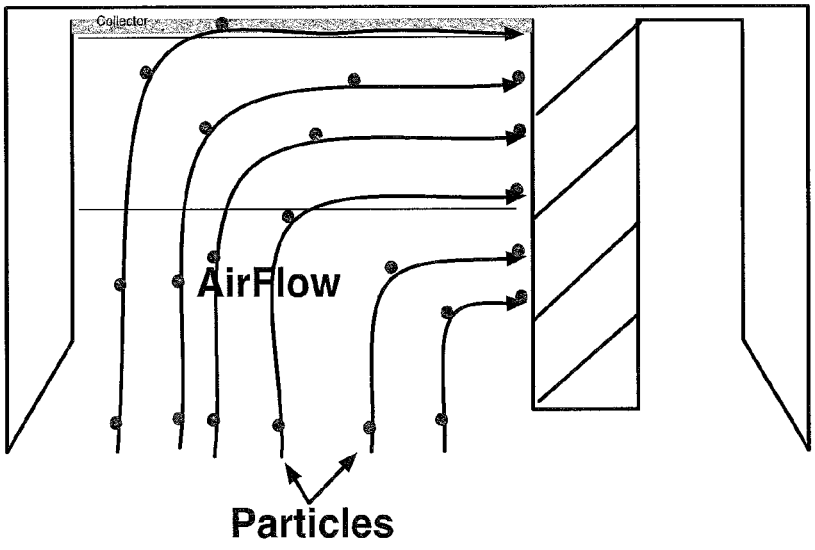
FIG. 7 is a path of particles with Particle Guide Technology. Very few particles get to collector pad without the Guide System in place.

The PGCS works as follows: Without the collector system turned on and only a simple collector pad were placed in the chilled beam, particles entrained in the air that make it back to the chilled beam would follow the path as described in FIG. 7. Very few particles get to the collector pad due to the force of airflow keeping the particles entrained it.

Figure 8:
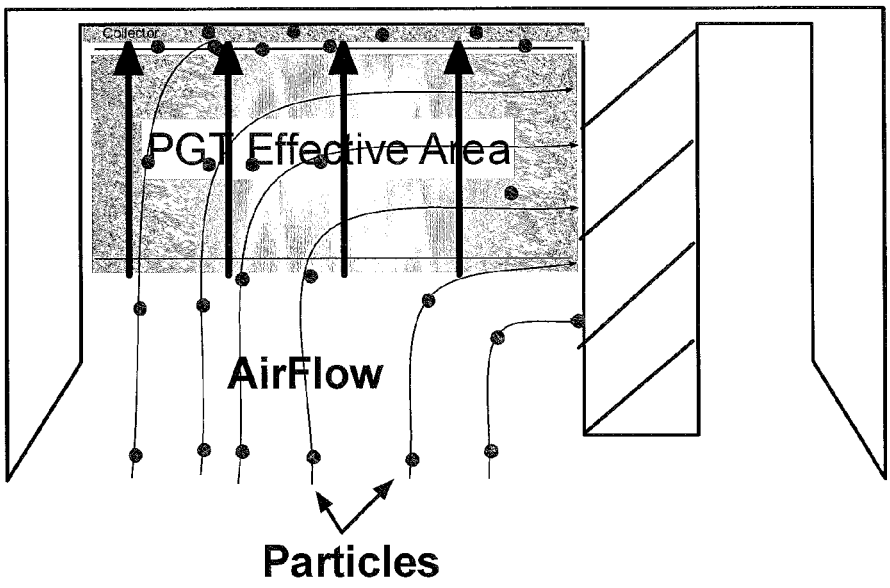
FIG. 8 is a path of particles with Particle Guide Technology. Most particles get to collector pad with the Guide System in place.

When the PGCS is incorporated, particles are driven (guided) to the collector by the strong electric field differences in the PGCS. The collector pad is condition to "grab" particles that are guided to it and keep them from leaving by strong ionic bonding that takes place in the collector pad due to the fields employed (FIG. 8).

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A system for filtering a flow of ambient air, the system having a very low pressure drop across a filter media, the system comprising:

a corona discharge apparatus including a housing and a series of parallel serrated blades within a housing, a power source for delivering an electric current to the blades, the current generating an electron cloud in the ambient air adjacent the serrated blades, the electron cloud ionizing particles within the ambient air, the corona discharge apparatus being perpendicular to the flow of the ambient air;

a V-shaped grid with an apex and a base, the V-shaped grid being connected to a power source for applying a negative current to the V-shaped grid, the apex being positioned adjacent the corona discharge apparatus;

upper and lower grids positioned above and below the V-shaped grid and perpendicular to the corona discharge apparatus, the upper and lower grids being connected to a power source and positively charged;

upper and lower dielectric pads secured in facing relation to the upper and lower grids and serving as a filter media;

whereby ionized particles from the corona discharge apparatus are repelled by the V-shaped grid and attracted by the upper and lower grids, the upper and lower grids thereby attracting particles into the upper and lower dielectric pads.

2. A system for filtering a flow of ambient air comprising:

a corona discharge apparatus including a housing within which a series of serrated blades are positioned, the serrated blades carrying a current and generating an electron cloud in the ambient air adjacent the blades;

an angled grid with an apex and a base, the angled grid carrying a current;

upper and lower grids positioned above and below the angled grid and adjacent to the corona discharge apparatus, the upper and lower grids being positively charged;

upper and lower filter media secured in facing relation to the upper and lower grids;

whereby ionized particles from the corona discharge apparatus are repelled by the angled grid and attracted by the upper and lower grids, the upper and lower grids thereby attracting particles into the upper and lower filter media.

3. The system as described in claim 2 wherein the corona discharge apparatus creates an electron cloud that ionizes particles within the ambient air, the corona discharge apparatus being perpendicular to the flow of the ambient air.

4. The system as described in claim 2 wherein the angled grid is V-shaped with an apex and a base and wherein the apex is adjacent the corona discharge apparatus.

5. The system as described in claim 2 wherein the upper and lower grids are orientated at a 90 degree angle to the corona discharge apparatus.

6. The system as described in claim 2 wherein the angled grid carries a negative current and the upper and lower grids carry a positive current.

7. The system as described in claim 2 wherein the angled grid carries a positive current and the upper and lower grids carry a negative current.

8. The system as described in claim 2 wherein the filter media is a conventional filter media.

* * * * *